United States Patent [19]

Rys

[11] 4,112,270

[45] Sep. 5, 1978

[54] MEANS CONNECTING CIRCUIT BREAKER AND AUXILIARY FEATURE MODULES

[76] Inventor: Tadeusz J. Rys, Bellefontaine, Ohio

[21] Appl. No.: 830,312

[22] Filed: Sep. 2, 1977

[51] Int. Cl.[2] ..... H01H 9/26

[52] U.S. Cl. ..... 200/50 C; 200/5 B; 200/307; 335/10; 335/17

[58] Field of Search ..... 200/50 R, 50 C, 5 B, 200/153 G, 307; 335/8-10, 17, 191

[56] References Cited

U.S. PATENT DOCUMENTS

| | | | |
|---|---|---|---|
| 2,889,428 | 6/1959 | Kingdon et al. | 335/10 X |
| 3,244,848 | 4/1966 | Chapin et al. | 200/307 |
| 3,505,621 | 4/1970 | Knecht | 335/8 |
| 3,840,833 | 10/1974 | Mrenna et al. | 200/50 C X |
| 3,958,087 | 5/1976 | Mol et al. | 200/307 X |
| 3,970,975 | 7/1976 | Gryctko | 335/17 X |
| 4,042,894 | 8/1977 | Coleman | 335/9 |

FOREIGN PATENT DOCUMENTS

| | | | |
|---|---|---|---|
| 2,291,602 | 6/1976 | France | 200/307 |
| 2,349,600 | 4/1975 | Fed. Rep. of Germany | 335/10 |

*Primary Examiner*—Robert S. Ward, Jr.

*Attorney, Agent, or Firm*—Ostrolenk, Faber, Gerb & Soffen

[57] ABSTRACT

A single pole circuit breaker module is constructed so that its housing is provided with frangible sections aligned with the pivot pins for the contact arm, the cradle and the operating mechanism latch. These pins are keyed to the elements mounted thereon and each pin is provided with a formation to engage a complementary formation projecting sideways from an auxiliary feature module. The latter includes one or more auxiliary devices. In the case of an auxiliary switch module, the switch thereof is connected to the contact arm pivot pin so that contact arm motion is transmitted to operate the auxiliary switch thereby indicating whether the circuit breaker is open or closed. In the case of an alarm switch auxiliary module, the switch thereof is connected to the pivot pin for the cradle whereby the tripping of the cradle is effective to operate the alarm switch. In the case of a shunt trip auxiliary module the solenoid operated member thereof is operatively connected to the pivot for the circuit breaker latch whereby actuation of the shunt trip solenoid serves to move the latch to its unlatched position for tripping of the circuit breaker.

10 Claims, 10 Drawing Figures

FIG. 3.
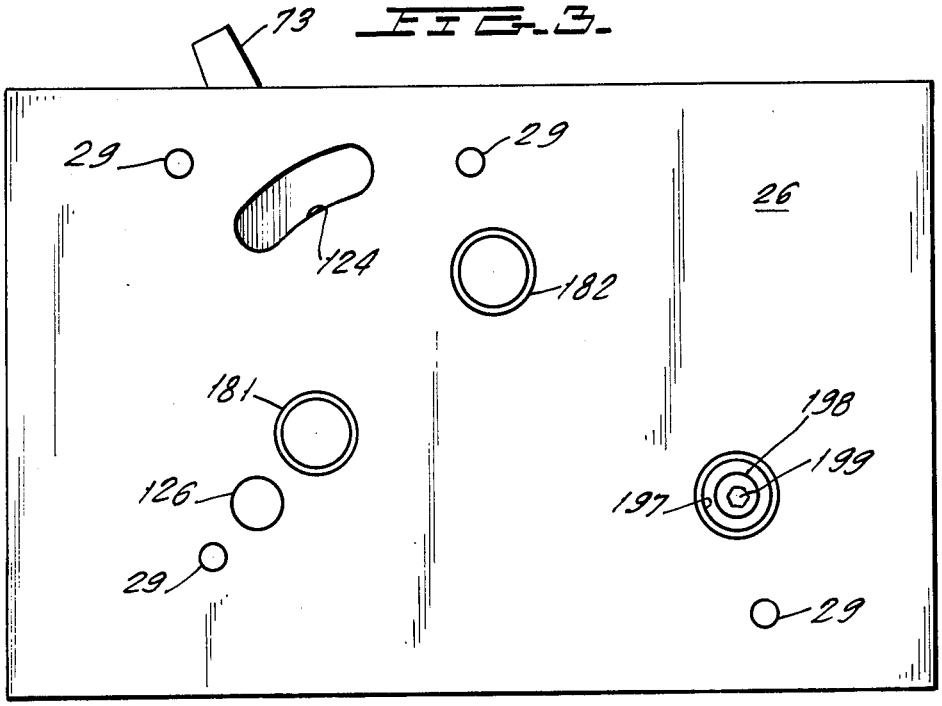
FIG. 5.
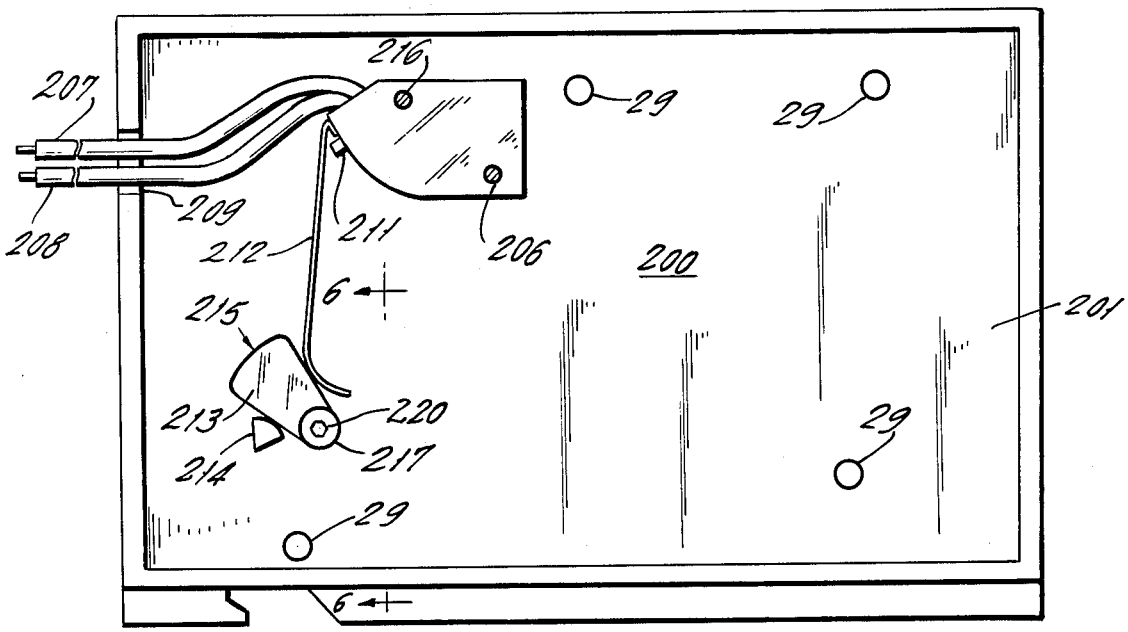
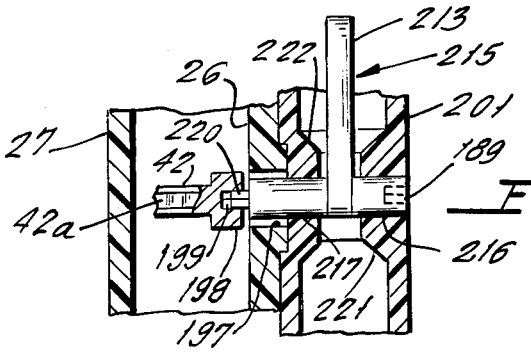
FIG. 6.

MEANS CONNECTING CIRCUIT BREAKER AND AUXILIARY FEATURE MODULES

This invention relates to circuit breakers in general and more particularly relates to means for connecting circuit breaker and auxiliary feature modules in operative mechanical relationship.

My copending application Ser. No. 703,078 filed July 6, 1976 describes the construction of a single pole circuit breaker module for moderately high current rating, say 150 amps. at 600 volts with an interrupting capacity of greater than 10,000 amps. The circuit breaker of the aforesaid copending application Ser. No. 703,078 is of particularly compact construction especially insofar as housing width is concerned. My copending application Ser. No. 763,888 filed Jan. 31, 1977 discloses means for stacking a plurality of the circuit breaker modules to form a multipole circuit interrupter.

The instant invention is concerned with means for making operative mechanical connections between circuit breakers of this type and suitable modules containing one or more auxiliary features such as auxiliary switches, shunt trip devices, etc. In accordance with the instant invention very little skill is required to connect the circuit breaker and auxiliary feature modules together in the field and such connection is made with minimal use of tools.

More particularly, the circuit breaker module is constructed so that the movable contact arm, the operating mechanism cradle and the latch therefor are each keyed to their respective pivot pins. The circuit breaker housing is provided with frangible sections aligned with each of these pivot pins. Each compatible auxiliary feature module contains a pivot extension projecting sideways so that it may extend through an opening in the circuit breaker housing formed by removing the appropriate frangible section.

The extension of the auxiliary feature interengages a complementary formation of an appropriate pivot pin of the circuit breaker module so that pivoted elements of the circuit breaker and auxiliary feature modules are keyed together for operation in unison. In this manner, switches may be operated by the contact arm and cradle, and the latch may be operated by shunt trip and under voltage devices.

Accordingly, a primary object of the instant invention is to provide effective, reliable and inexpensive means to transmit angular displacements between circuit breaker and auxiliary feature modules.

Another object of this invention is to provide field connectible means for transmitting angular displacements between circuit breaker and auxiliary feature modules.

These objects as well as other objects of this invention shall become readily apparent after reading the following description of the drawings in which:

FIG. 1 is a side elevation looking in the direction of arrows 1, 1 of FIG. 4 and showing a circuit breaker pole unit, constructed in accordance with teachings of the instant invention, with the near housing half removed to reveal the internal elements.

FIG. *2a* is a fragmentary plan view in the vicinity of line *2a, 2a* of FIG. 1 looking in the direction of arrows *2a, 2a* to illustrate the line terminal number disposed within the housing.

FIG. *2b* is a plan view through line *2b, 2b* of FIG. 1 looking in the direction of arrows *2b, 2b* to illustrate the position of the contact operating elements in the housing.

FIG. *2c* is a cross-section taken through line *2c, 2c* of FIG. 1 looking in the direction of arrows *2c, 2c.*

FIG. 3 is a side elevation of the pole unit looking in the direction of arrows 3, 3 of FIG. *2c.*

FIG. 5 is a side elevation of the auxiliary unit of FIG. 4, looking in the direction of arrows 1, 1 of FIG. 4, with its near housing half removed to reveal the internal elements.

FIG. 6 is a fragmentary cross-section taken through line 6—6 of FIG. 5 looking in the direction of arrows 6, 6, and showing the mechanical operating connection between the pole unit and the auxiliary unit.

Figure 1:
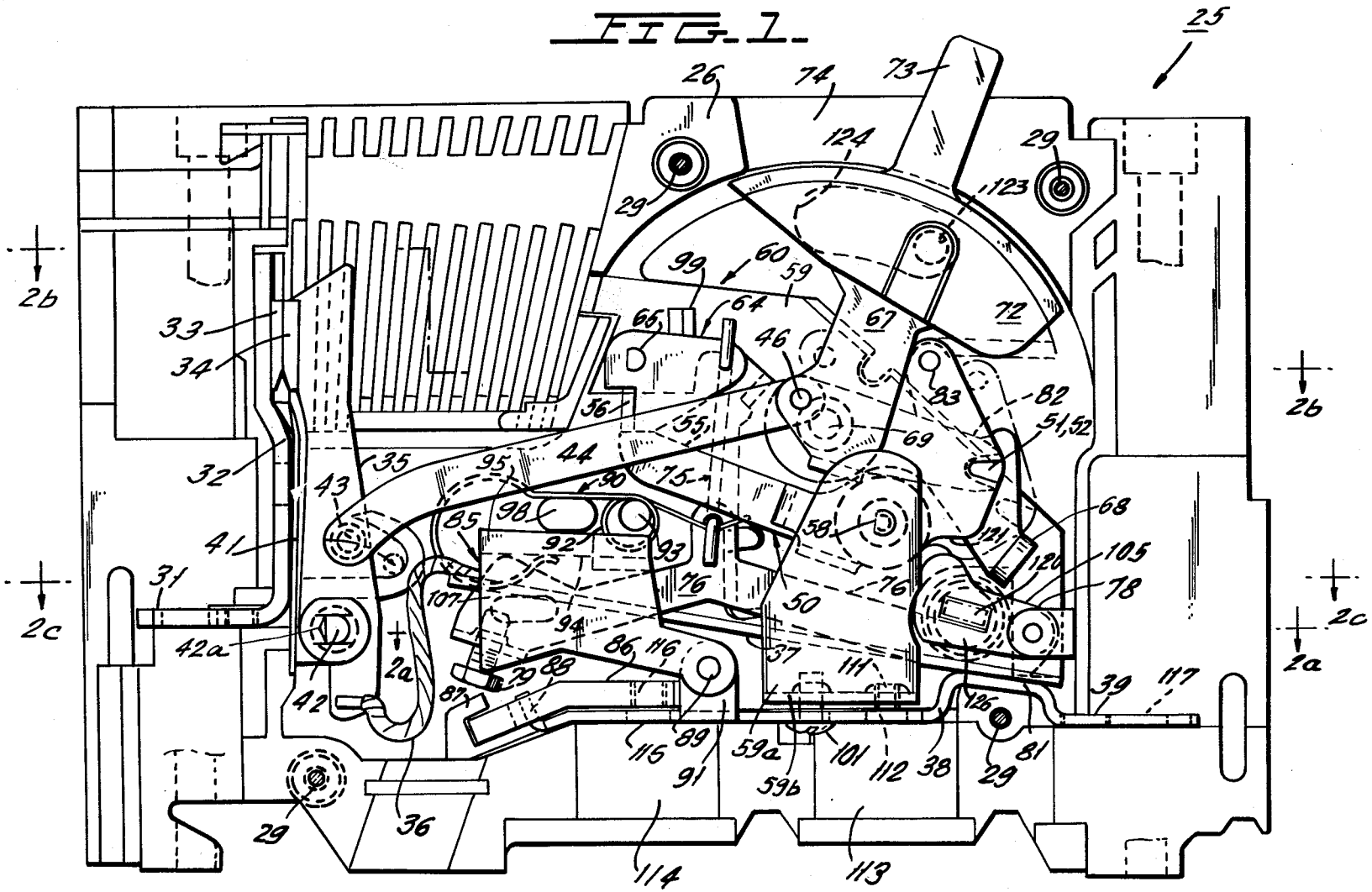

Now referring to the Figures. Circuit breaker pole unit or module 25 of FIG. 1 provided with molded insulating housing consisting of sections 26, 27 which mate at line 28 and are secured together by rivets 29. The current carrying path through circuit breaker 25 extends from load terminal 31, to which a wire grip (not shown) may be mounted, stationary contact 33 at the end of load terminal strap 32 remote from load terminal 31, movable contact 34 at one end of movable contact arm 35, through contact arm 35 and braid 36 connected to the other end of arm 35, through bimetal 37 to line terminal member 38 whose right end 39 is positioned for mounting of a wire grip (not shown).

Thin insulating sheet 41 is interposed between movable contact arm 35 and load terminal strap 32 to electrically insulate these elements for a major portion of the length of contact arm 35. However, these elements are so close to one another that current limiting through contact blow-off is achieved by interaction of magnetic fields which accompany current flow in strap 32 and arm 35.

The lower end of contact arm 35 is pivotally mounted on a fixed pivot provided by pin 42 whose ends extend into recesses in both housing portions 26 and 27. Pin 43, located at a point between movable contact 34 and pin 42, connects contact arm 35 to one end of toggle link 44 having its other end connected by pin 46 to the other toggle member 47. Bearing pin 42 and connecting pin 43 for contact arm 35 are secured by pressed on friction nuts 136, 137, respectively, (FIGS. *2b* and *2c*). One end of pin 43 extends substantially beyond toggle link 44 so as to be engageable by internal housing formation 138 which acts as a stop to limit opening movement of contact arm 35.

Link 44 consists of two identical parallel arms spaced by the thickness of contact arm 35. Toggle link 47 is a bifurcated element having parallel sections 48, 48 (FIG. *2b*) provided with a V-notch 51 which receives a boss 52 on the inner surface of parallel walls 53, 53 (FIG. *2b*) of cradle 50 which are joined by web 54. One of the walls 53, 53 is provided with latching tip extension 55 engageable by latching protrusion 56. Aligned apertures in walls 53, 53 receive pin 58 which pivotally mounts cradle 50 to formed mounting plate or frame 60 at aligned apertures in main wall 59 and auxiliary wall 59*a* of plate 60. Web section 59*b* connects walls 59, 59*a* in spaced parallel relationship. Screw 101 (FIG. 1) extends through clearance aperture 102 in terminal member 38 and is received by a threaded aperture in web 59*b* to secure mounting plate 60 to member 38. Cantilevered latching protrusion 56 extends perpendicular to the main planar portion of latch member 64 and is formed integrally therewith. Member 64 is pivotally mounted on plate 60 by cantilevered pivot pin 65.

Figure 2A:
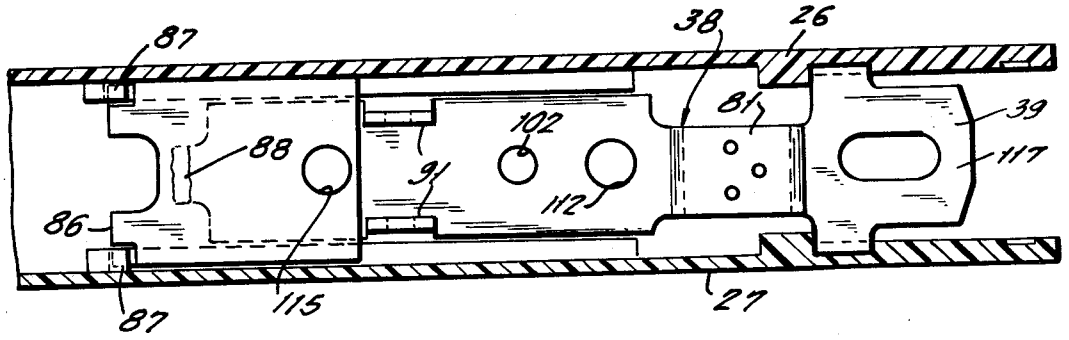
Figure 2B:
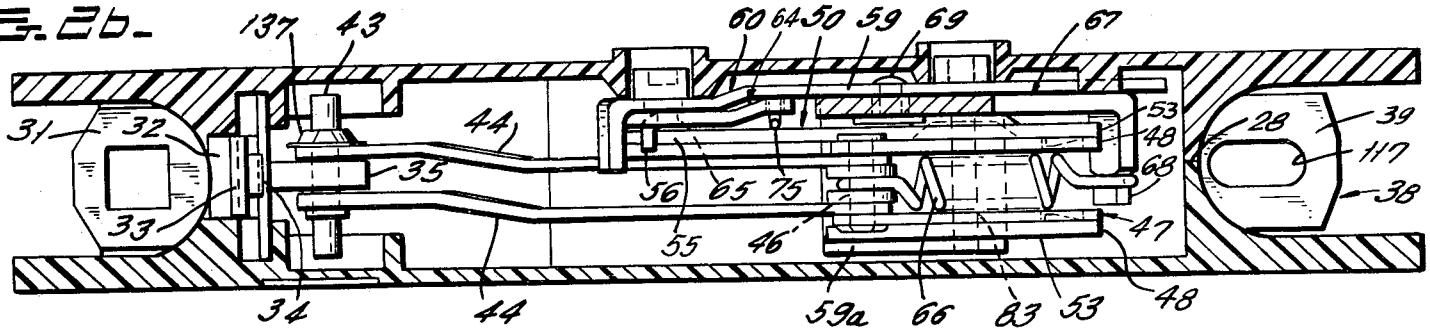

Main operating spring 66 (FIG. 2*b*) is a coiled tension member connected at one of its ends to toggle knee pin 46 and at the other of its ends to operating member 67 at projection 68 thereof. Member 67 is mounted to main wall 59 of mounting member 60 by pivot pin 69. The upper end of operating member 67 extends into a complementary recess in the lower surface of handle 72. The latter includes extension or handle 73 which projects through housing opening 74 so that handle 73 is engageable for manual operation of circuit breaker 25.

Figure 2C:
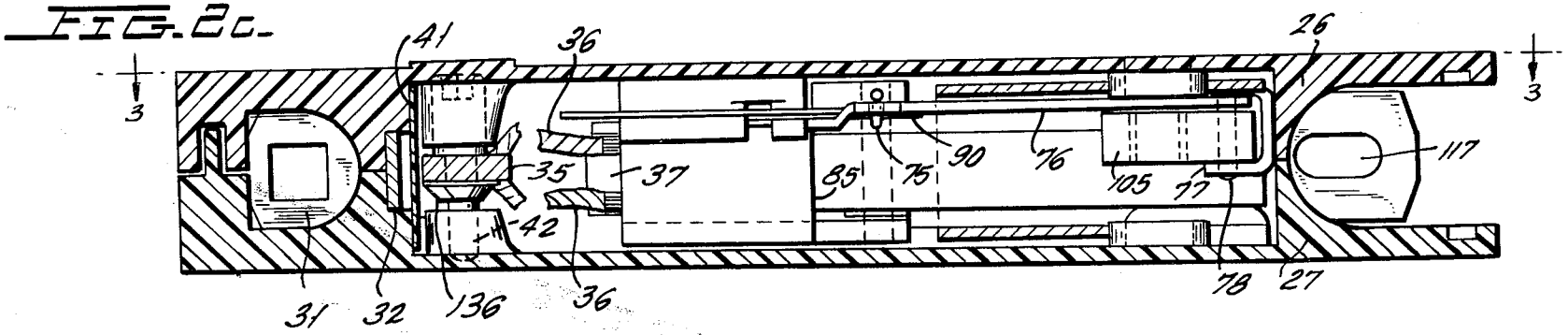

Formed wire link 75 connects latch member 64 to trip member 76 at a point intermediate the ends of the latter. Member 76 is pivotally mounted at one of its ends to mounting member ear 77 by pin 78 which also pivotally mounts plastic interpole trip lever 105 (FIG. 2*c*). Lever 105 and member 76 are disposed side-by-side between ear 77 and wall 59. Adjustment screw 79 is threadably mounted to end of trip member 76 remote from pin 78. As seen in FIG. 1, the right end of the bimetal 37 is fixedly secured to inclined offset 81 of line terminal member 38 and the free end of bimetal 37 is aligned with screw 79. Upon heating of bimetal 37 due to abnormal current conditions existing for an extended period of time, the free end of bimetal 37 deflects and engages screw 79 to pivot trip member 76 counterclockwise with respect to FIG. 1. This moves link 75 downward to pivot latch member 64 clockwise whereby latch 56 releases cradle tip 55. Now, under the influence of main operating spring 66 cradle 50 pivots clockwise and moves the right end of toggle 44, 47 below the line of action of spring 66 so that the latter is effective to move toggle knee 46 rapidly to the right with respect to FIG. 1 causing contact arm 35 to pivot clockwise and separate movable contact 34 from stationary contact 33.

To reset cradle 50, handle 73 is moved to the left with respect to FIG. 1 with resetting surface 82 of operating member 67 engaging reset pin 83 mounted on cradle 50 to move the latter counterclockwise until latch tip 55 falls below latch 56. Subsequent movement of handle 73 to the right with respect to FIG. 1 moves the right end of spring 66 downward until its line of action is below the right end of toggle 44, 47 at which point spring 66 moves toggle knee 46 downward. This extends toggle 44, 47 thereby moving contact 34 into engagement with contact 33. For manually opening, circuit breaker 25 handle 73 is moved to the left with respect to FIG. 1 and in so doing the right end of spring 66 is moved above the right end of toggle 44, 47 so that the line of action of spring 66 is then directed to collapse toggle 44, 47 and separate movable contact 34 from stationary contact 33.

In addition to thermal trip means provided by bimetal 37, circuit breaker 25 also includes magnetic or instantaneous trip means comprising stationary magnetic plate 86 and U-shaped armature 85 having arms 107 between which bimetal 37 extends. The left edge of plate 86 is captured under housing formation 87 and plate 86 is secured to the upwardly extending tab 88 at the left end of line terminal member 38. Pin 89 pivotally mounts armature 85 to upwardly extending ears 91 of line terminal member 38. Dual purpose formed wire spring 90 includes central looped portion 92 that receives housing formation 93. The left end of spring 90 is curved and reversely bent to engage inner surface 94 of armature 85 at its web portion 95. The right end of spring 90 is interposed between an offset end portion of link 75 and trip member 76 to bear against link 75. The loading and positioning of spring 90 is such that it biases armature 85 clockwise against housing formation stop 98 and also biases link 75 upward. This biases trip member 75 clockwise about its pivot 78 and biases latch member 64 counterclockwise toward its latching position in engagement with mounting plate stop formation 99.

Threaded aperture 111 is aligned with clearance aperture 112 in line terminal member 38 to provide means whereby a screw (not shown) may be used to electrically and mechanically secure a line terminal stab (not shown), positioned in housing recess 113, to line terminal member 38. For connecting the line terminal stab at another location along the length of line terminal member 38, the circuit breaker housing is provided with another recess 114 aligned with clearance aperture 115 in strap 83 and threaded aperture 116 in stationary magnetic member 86. The end of line terminal member 38 remote from magnetic member 86 is provided with elongated aperture 117 for connection of a wire grip device (not shown).

When a plurality of circuit breaker pole units 25 are mounted side by side and it is desired to mechanically coordinate tripping thereof such that automatic tripping of one unit will cause all of the other units to trip, flat transverse insulating bar 120 (FIG. 1) is provided. The latter extends through a complementary aperture in trip member 105 for each of the circuit breaker poles 25. When an abnormal current condition causes automatic tripping of a pole, cradle 50 thereof is released and moves clockwise so that section 121 thereof moves downward and engages trip lever 105 pivoting the latter counterclockwise to move trip bar 120 downward. This causes the latter to engage the trip members 76 in all of the poles to move these trip members counterclockwise thereby releasing the trip latches 64 in each of the non-faulted poles. Therefore all of the non-faulted poles open substantially at the same time the faulted pole opens. For simultaneous on-off operation of a plurality of pole units 25 arranged in a stack, a transverse rod (not shown) extends through aligned apertures 123 in each of the operating members 67. When this type of transverse rod is utilized at least one of the sides of housing 26, 27 is broken away at arcuate frangible section 124. Similarly, circular apertures are provided in one or more of the sides of housing 26, 27 by breaking away frangible section 126 to provide clearance for interpole trip bar 120.

Figure 7:
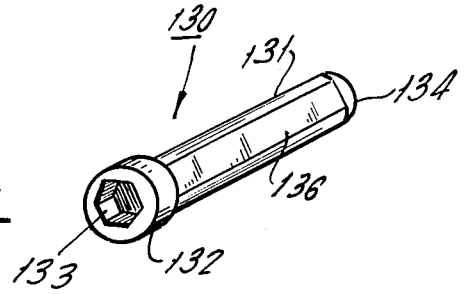
FIG. 7 is a perspective of a hex head socket rivet.

The pivot pins, 58 for cradle 50, 42 for contact arm 35 and 65 for trip latch 64, are constituted by socket rivets of the type illustrated in FIG. 7. Rivet 130 of FIG. 7 includes shaft 134 and head 132 positioned at one end of shaft 134. The free end of head 132 is provided with hexagonal socket 133 centered with respect to the cylindrical axis of shaft 134. In transverse section, shaft 143 consists of flat surface 136 and circular surface 131 extending for more than 180°. The aforesaid cylindrical axis coincides with the center about which circular surfce 131 is generated and also coincides with the center of a bearing aperture through which shaft 134 extends. A member mounted to socket rivet 130 is secured thereto in keying relationship so that the angular position of rivet 130 indicates the position of the element secured thereto. As will now be explained, this becomes useful when circuit breaker pole unit 25 is operated in conjunction with auxiliary features such as auxiliary switches, shut trip devices, alarm switches, etc.

Figure 4:
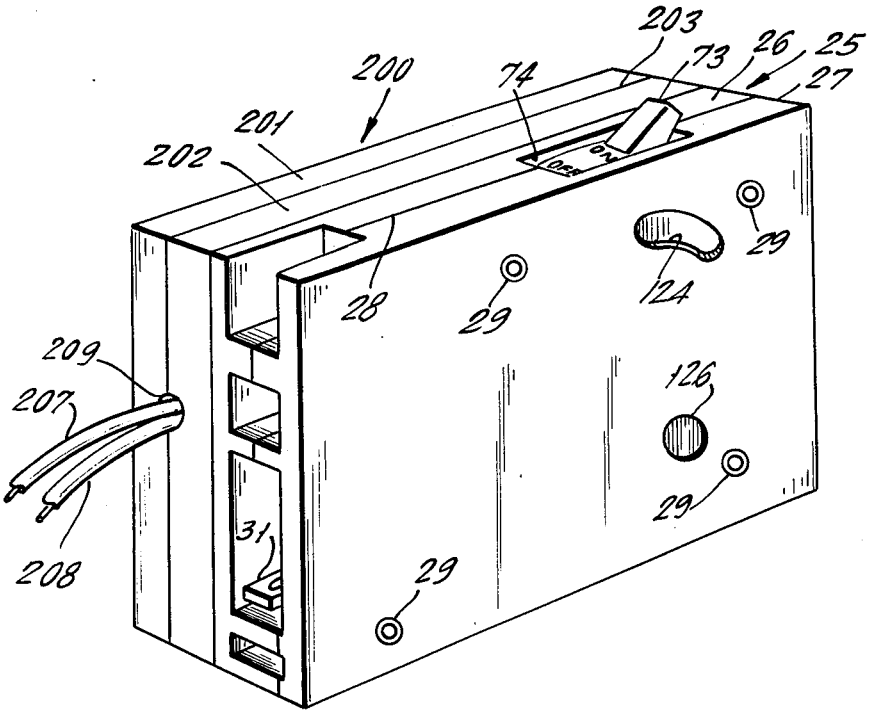
FIG. 4 is a perspective of the pole unit of FIG. 1 assembled with an auxiliary unit.

In FIG. 4 circuit breaker module 25 is shown mounted in adjacent side by side relationship with auxiliary unit or module 200. The latter includes a molded insulating housing consisting of sections 201, 202 which mate at line 203 and are secured together by rivets 29. The housings for module 25 and 200 have approximately the same outer dimensions. The interior of housing 201, 202 is hollow and has disposed therein an auxiliary switching device in the form of micro switch unit 205 secured to the main wall of housing section 201 by screws 206, 206.

The cooperating contacts (not shown) of micro switch 205, either normally opened or normally closed as the case may be, are connected to insulated leads 207, 208 which extend through opening 209 in the end of housing 201, 202 adjacent the load end of circuit breaker 25. Contact actuator 211 of micro switch 205 is biased toward the normal projected position seen in FIG. 5, and is operatively engageable by leaf spring 212 for movement to a retracted position. Spring 212 is operatively positioned so that the curved portion near its free end is engaged with one edge of fan-shaped vane 213 to bias the latter against stop 214 formed integrally with housing section 201. Vane 213 is part of operator 215 which also includes integrally formed aligned bearing formations 216, 217 projecting from opposite surfaces of vane 213 and at right angles with respect thereto.

Confronting bosses 221, 222 of housing sections 201, 202 respectively are provided with aligned bearing apertures which receive the respective bearings 216, 217 to pivotally mount operator 215 so that vane 213 moves in a plane generally parallel to the sides of housing 201, 202. Hexagonal keying extension 220 is in axial alignment with bearing sections 216, 217 and extends outwardly from the free end of the latter outside of housing section 202. A frangible portion of housing section 26 is broken away to form clearance aperture 197 in alignment with head 198 of contact arm pivot pin 42. Extension 220 projects through aperture 197 and is received in keying relationship by hexagonal recess or pocket 199 in head 198 so that pin 42 and actuator 215 are keyed together in operative mechanical relationship. Since contact arm 35 is keyed to pin 42 because of the flat shaft portion **42*a* of the latter, contact arm 35 is operatively keyed to actuator 215. Thus, when movable contact 34 separates from stationary contact 33 by having movable contact arm 35 pivot clockwise with respect to FIG. 1, operator 215 is caused to pivot clockwise with respect to FIG. 5. This motion of operator 215 is transmitted through spring 212 to actuator 211 of auxiliary switch 205** causing contacts of the latter to operate.

In a similar manner, housing section 26 is also provided with frangible sections 181, 182 (FIG. 3) which are aligned with the respective latch and cradle pivot pins 58, 65. Thus, cradle 50 may be used to operate an alarm switch in another auxiliary module (not shown) of a construction similar to the construction of auxiliary module 200. Similarly, still another auxiliary module (not shown) may be provided with a shunt trip and/or undervoltage device which is keyed to latch pivot pin 65 for tripping latch 64 from a remote location and/or as a result of predetermined low voltage conditions. If desired, a single auxiliary module may include a plurality of auxiliary features, an auxiliary switch connected to a circuit breaker contact arm and an alarm switch connected to the circuit breaker cradle.

Another auxiliary module having the same construction as auxiliary module 200 may be mounted adjacent to housing section 201. The auxiliary switches of both of these auxiliary modules will be interconnected for simultaneous operation by having the hexagonal extension of the outboard auxiliary module keyed with the hexagonal recess 189 in the free end of bearing formation 216.

Figure 8:
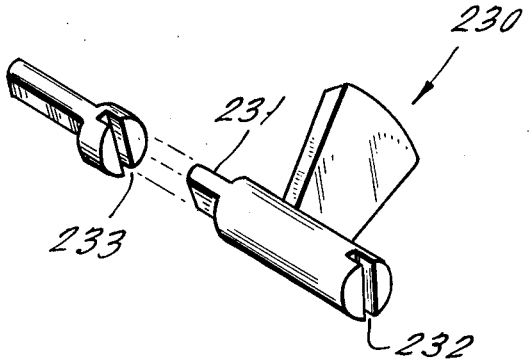
FIG. 8 is an exploded perspective of another embodiment of the instant invention.

As seen in FIG. 8, the hexagonal keying extension 220 and hexagonal recess 189 of operator 215 may be replaced by blade-like extension 231 and narrow recess 232 at opposite ends of the bearing portion of operator 230. When operator 230 is utilized, it is necessary to provide each of the keying rivets with a narrow slot 233, instead of hexagonal socket 199, to receive extension 231 in driving relation.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Electrical circuit controlling apparatus comprising a circuit breaker including cooperating movable and stationary contacts; a contact arm carrying said movable contact, latch pivot means pivotally mounting said contact arm for movement between contact open and closed positions, an operating mechanism connected to said contact arm for opening and closing said contacts, said mechanism including a releaseable cradle and cradle pivot means pivotally mounting said cradle for movement between reset and tripped positions, said mechanism also including a latch and latch pivot means pivotally mounting said latch for movement between latching and unlatching positions, said latch when in said latching position holding said cradle in said reset position, said mechanism automatically opening said contacts when said cradle is in said tripped position; a first of said pivot means including a first pin keyed to the element pivotally mounted by said first of said pivot means; said first pin including an axially disposed connecting means for making an operative mechanical connection to an axially disposed cooperating connecting means on a bearing of an operator for an auxiliary feature which is to operate in conjunction with said circuit breaker.

2. Controlling apparatus as set forth in claim 1 in which a second of said pivot means includes a second pin keyed to the element pivotally mounted by said second pivot means; and second pin including an axially disposed connecting means for making an operative mechanical connection to an axially disposed cooperating connecting means on a bearing of an operator for an auxiliary feature which is to operate in conjunction with said circuit breaker.

3. Controlling apparatus as set forth in claim 2 in which a third of said pivot means includes a third pin keyed to the element pivotally mounted by said third pivot means; and third pin including an axially disposed connecting means for making an operative mechanical connection to an axially disposed cooperating connecting means on a bearing of an operator for an auxiliary feature which is to operate in conjunction with said circuit breaker.

4. Controlling apparatus as set forth in claim 1 in which the circuit breaker is part of a circuit breaker module having a narrow insulating circuit breaker housing wherein previously recited elements of said circuit breaker are disposed with said first pin having its pivot axis extending widthwise of said housing.

5. Controlling apparatus as set forth in claim 4 in which said circuit breaker housing includes a side wall having a first frangible portion aligned with said first pin and proportioned so that said connecting means of said first pin is accessible through first aperture provided by breaking away said first frangible portion.

6. Controlling apparatus as set forth in claim 5 in which the side wall also has a second frangible portion aligned with said second pin and proportioned so that said connecting means of said second pin is accessible through second aperture provided by breaking away said second frangible portion.

7. Controlling apparatus as set forth in claim 6 in which the side wall also has a third frangible portion aligned with said third pin and proportioned so that said connecting means of said third pin is accessible through third aperture provided by breaking away said third frangible portion.

8. Controlling apparatus as set forth in claim 4 also including an auxiliary feature module having a narrow insulating auxiliary housing positioned in side by side relation to said circuit breaker housing, an auxiliary feature disposed within said auxiliary housing and including a bearing having a connecting means in operative mechanical engagement with the connecting means of the first pin whereby said auxiliary feature and said element mounted to the first pin operate in conjunction with each other.

9. Controlling apparatus as set forth in claim 8 in which the connecting means of the bearing includes an extension projecting outboard of said auxiliary housing through a side opening thereof, said connecting means of said pin including a depression at one end thereof wherein said extension is entered.

10. Controlling apparatus as set forth in claim 9 wherein said bearing is part of an operator which also includes an operating portion extending radially from said bearing and is pivotally mounted for movement in a plane parallel to the sides of the auxiliary housing to transfer mechanical operating motion between the element keyed to said first pin and a device disposed within said auxiliary housing and constituting a portion of the auxiliary feature.

* * * * *

UNITED STATES PATENT AND TRADEMARK OFFICE

CERTIFICATE OF CORRECTION

PATENT NO. : 4,112,270

DATED : September 5, 1978

INVENTOR(S) : Tadeusz J. Rys

It is certified that error appears in the above-identified patent and that said Letters Patent are hereby corrected as shown below:

Column 6, line 29 - please delete "latch" and substitute therefor --arm--

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*